US005257705A

United States Patent [19]

de Santana

[11] Patent Number: 5,257,705

[45] Date of Patent: Nov. 2, 1993

[54] FLASK CAP

[75] Inventor: Gildete V. de Santana, Sao Paulo, Brazil

[73] Assignee: JBO Commercial Ltda., Brazil

[21] Appl. No.: 871,381

[22] Filed: Apr. 21, 1992

[30] Foreign Application Priority Data

Jan. 24, 1992 [BR] Brazil ..... MU 7200150[U]

[51] Int. Cl.[5] ..... B65D 41/34

[52] U.S. Cl. ..... 215/252; 215/256

[58] Field of Search ..... 215/252, 203, 256, 258

[56] References Cited

U.S. PATENT DOCUMENTS

| | | | |
|---|---|---|---|
| 4,448,317 | 5/1984 | Thompson | 215/203 |
| 4,461,390 | 7/1984 | Csaszar | 215/252 |
| 4,664,279 | 5/1987 | Osrist et al. | 215/252 |
| 4,666,053 | 5/1987 | Corcoran et al. | 215/252 |
| 4,720,018 | 1/1988 | Schetzsle et al. | 215/252 |
| 4,905,851 | 3/1990 | Thompson | 215/203 |
| 5,131,550 | 7/1992 | Thompson | 215/252 |

*Primary Examiner*—Allan N. Shoap
*Assistant Examiner*—Paul A. Schwarz
*Attorney, Agent, or Firm*—Merchant, Gould, Smith, Edell, Welter & Schmidt

[57] ABSTRACT

An inviolable cap for a flask which provides proof when tampered with. The cap has an interconnecting wall in a region where the body and the band of the cap adjoin one another. The wall includes a plurality of cut segments aligned in a circular fashion thereabout separated by a plurality of transverse interruptions, with one of the interruptions being at least twice as long as any of the cut segments and the rest of the transverse interruptions being substantially shorter than any of the cut segments. The band further includes a vertical cut with vertical interruptions. A projection on the band fits about a collar on the flask. When the cap is unscrewed, the shorter transverse and the vertical interruptions sever.

3 Claims, 5 Drawing Sheets

FLASK CAP

FIELD OF THE INVENTION

This invention relates to a CAP specially developed for use on various types of flasks of the disposable or returnable type, because, in these and other cases, it is important that a cap be provided with an inviolable device to provide evidence that the cap has been opened for the first time and also including means for same to be used while the flask still contains part of the product, as in the case of carbonated beverages.

BACKGROUND OF THE INVENTION

Various models of caps, at present, are provided with the above means. However, in the majority of cases, they are equally comprised of a cylindrical body whose upper end is completely closed, while the lower portion includes an inviolable device made up by a severable band interconnected with the said body by means of severable bridges or links and, in addition, the said band is provided with internal means in the form of teeth or a suitable groove to provide coupling action between the bottleneck and the cap when the latter is screwed onto the bottleneck because, at this moment, the teeth or groove will extend beyond a collar disposed on the bottleneck, thereby providing a kind of irreversible grasp, which is to say, regardless of the internal design of the seal, the same is designed to withstand the coupling action between the cap and flask, making it easier for the band to extend beyond the collar but, in an opposite direction, causing said links or bridges to split with ease, thus giving proof that the assembly has been tampered with or, in other words, if the cap is unscrewed, there is no way of avoiding the band being fastened to the collar, causing the separation thereof from the body of the flask, which separation, however, will be incomplete because one of the regular features is also the fact that the band will be practically transformed into a strip, held by one end to the body of the flask and thereby preventing any further attempt of removal, which is an important factor when the flask is of the returnable type.

A regular feature in known caps is that all the bridges split at the same time, which calls for a stronger effort to unscrew the cap and also increases the possibility of failure in the sealing system, while, in some cases, the band remains attached to the bottleneck and needs to be removed when the bottle is returned for a refill.

To overcome the aforementioned inconveniences, Utility Model No. 7,101,554 was created and filed on July 7, 1991, under the same title "FLASK CAP", in which important changes were introduced, all designed so that, when the cap is unscrewed, the band may come apart gradually from the body of the cap, causing the bridges to break almost one at a time, so that almost no effort is required to open the flask and, in addition, a different bridge and a nonseverable connecting section are provided, so that one of the ends of the band or strip may remain attached to the body of the cap. These changes have made it possible for an even more fragile seal to be provided, which makes it impossible for the container to be opened without destroying the seal on the bottleneck and also making it impossible for the seal's strip to remain attached to the bottleneck.

SUMMARY OF THE INVENTION

The subject model is designed to provide a further technical enhancement of the aforementioned cap or, in other words, to replace the severable bridges with an almost invisible cutting line with various interruptions, one of which is substantially larger, so that, when this invisible line is fully severed, the strip will, unavoidably, remain attached to the skirt of the cap, as in the case of the previous model.

BRIEF DESCRIPTION OF THE DRAWINGS

For a better understanding of the present invention, a detailed description thereof will now be provided, with reference to the attached drawings, wherein.

DETAILED DESCRIPTION OF THE PREFERRED EMBODIMENT

According to these illustrations and details thereof, especially as concerns FIGS. 1 through 4, the present invention of the type commonly manufactured with plastic material by the well-known injection-molding process, is comprised of a flat upper disk [1]whose edge, after rounding [2], extends vertically downward, thereby providing the cylindrical skirt [3]which, as well as having a nonslip surface [4], is also provided with suitable inside threads and, further, with its lower portion including an inviolable device [6]comprised of telltale band or strip [7]interconnected to the body [1]by means of a wall or natural extension [8]of the skirt itself [3], the outside surface of the telltale band [7]being provided with an equally circular, continuous projection or integral tooth [9], over almost all the inner surface of the aforementioned band.

The integral tooth [9]is designed to feature an angular profile with an inwardly turned vertex whose lower face is substantially more slanted than the upper face, so that the former may assist said tooth in extending over and beyond the bottleneck's collar "C" so as to achieve full coupling action, after which the less-slanted upper portion remains beneath the collar and the irreversible coupling action of the two parts is achieved.

Figure 1:
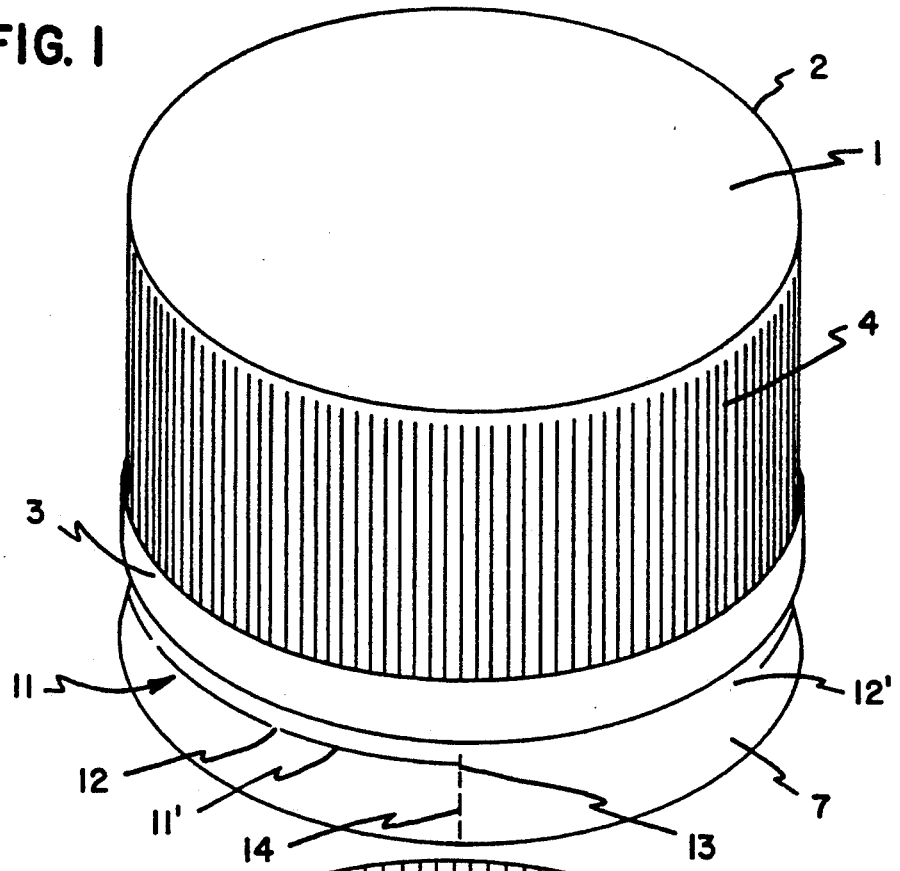
FIG. 1 illustrates a perspective view from an upper angle in which the model's external details are featured.
Figure 2:
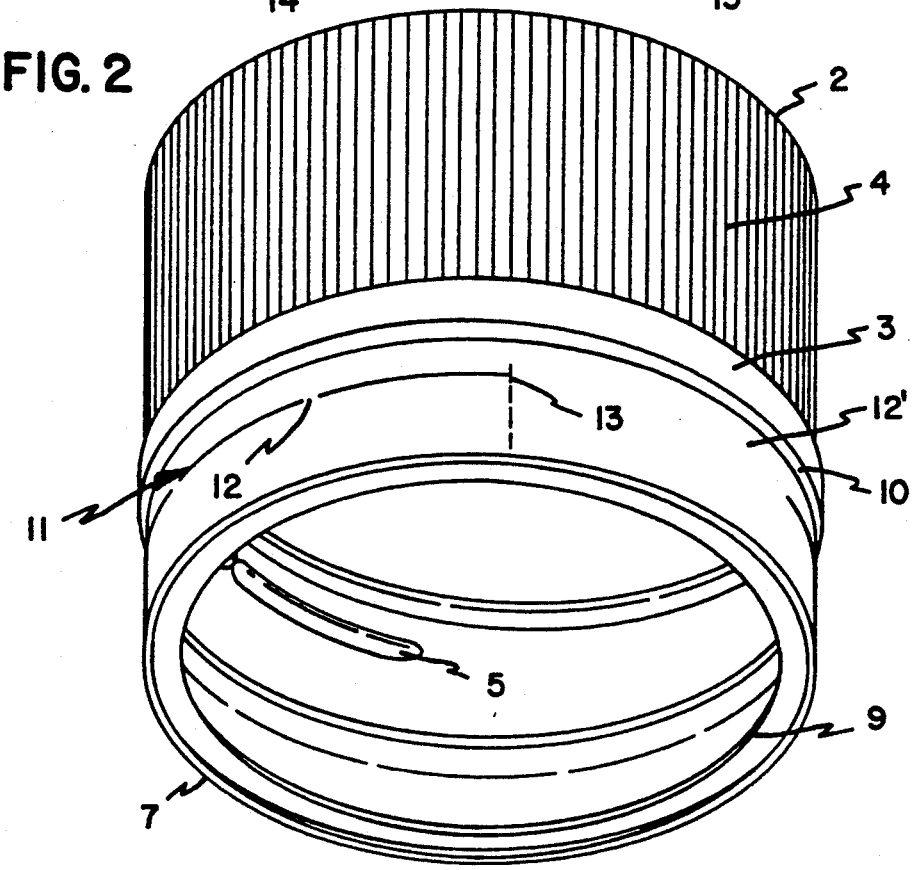
FIG. 2 provides a similar view to the previous one, but from a lower angle, in which other details of the model are featured.
Figure 3:
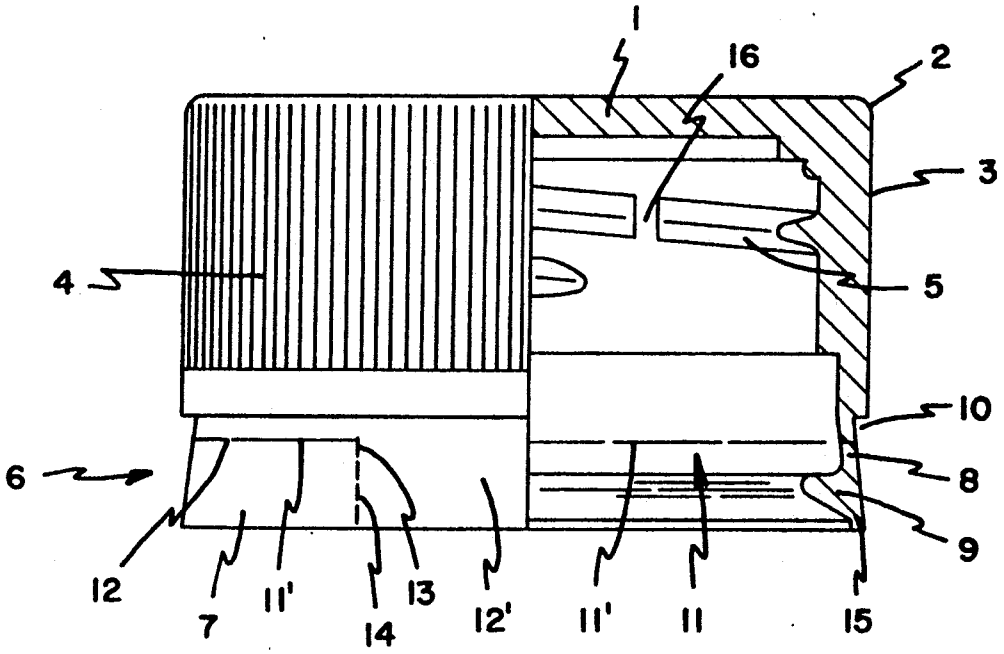
FIG. 3 is a side cutaway view, in which the cap's inside details are featured, mainly as concerns the sealing system.
Figure 4:
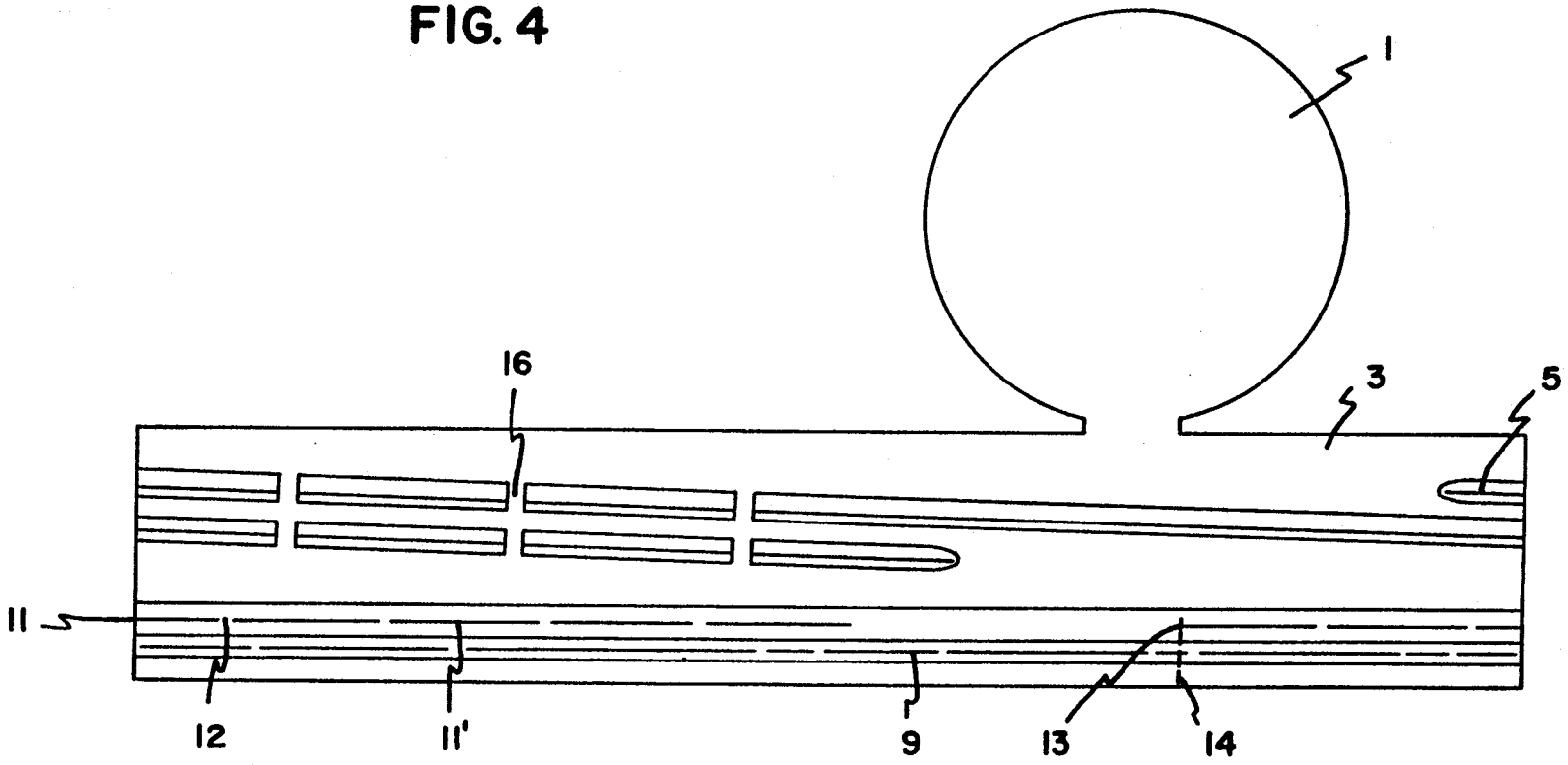
FIG. 4 is a special view of the fully extended cylindrical skirt, showing the cap's internal details, mainly as concerns the modified components.
Figure 6:
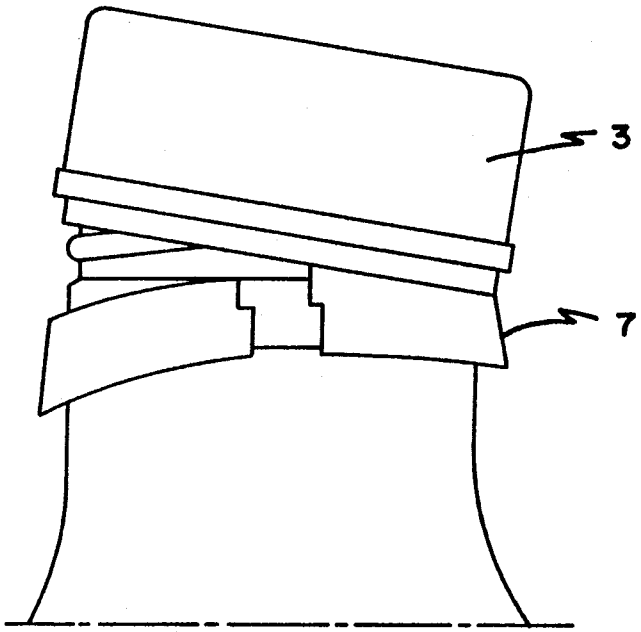
FIGS. 5, 6 and 7 provide illustrations of a few stages during which the seal is broken when the cap is removed.
Figure 5:
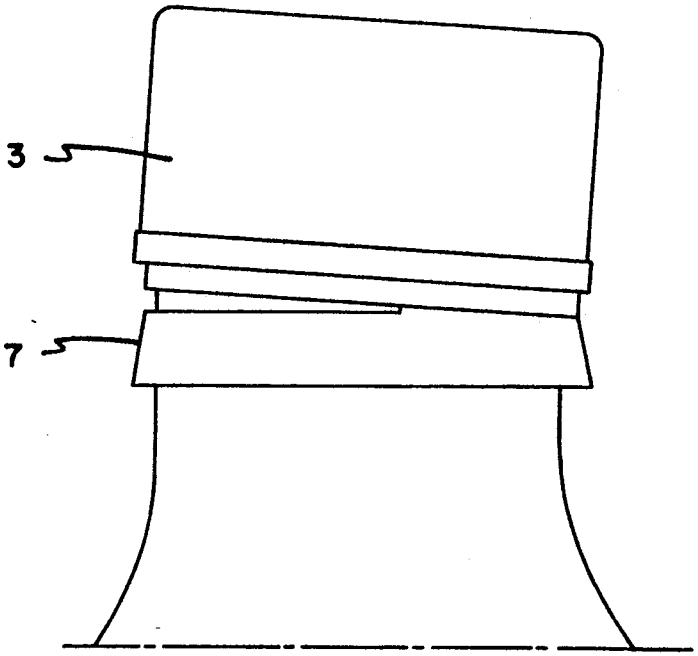
Figure 7:
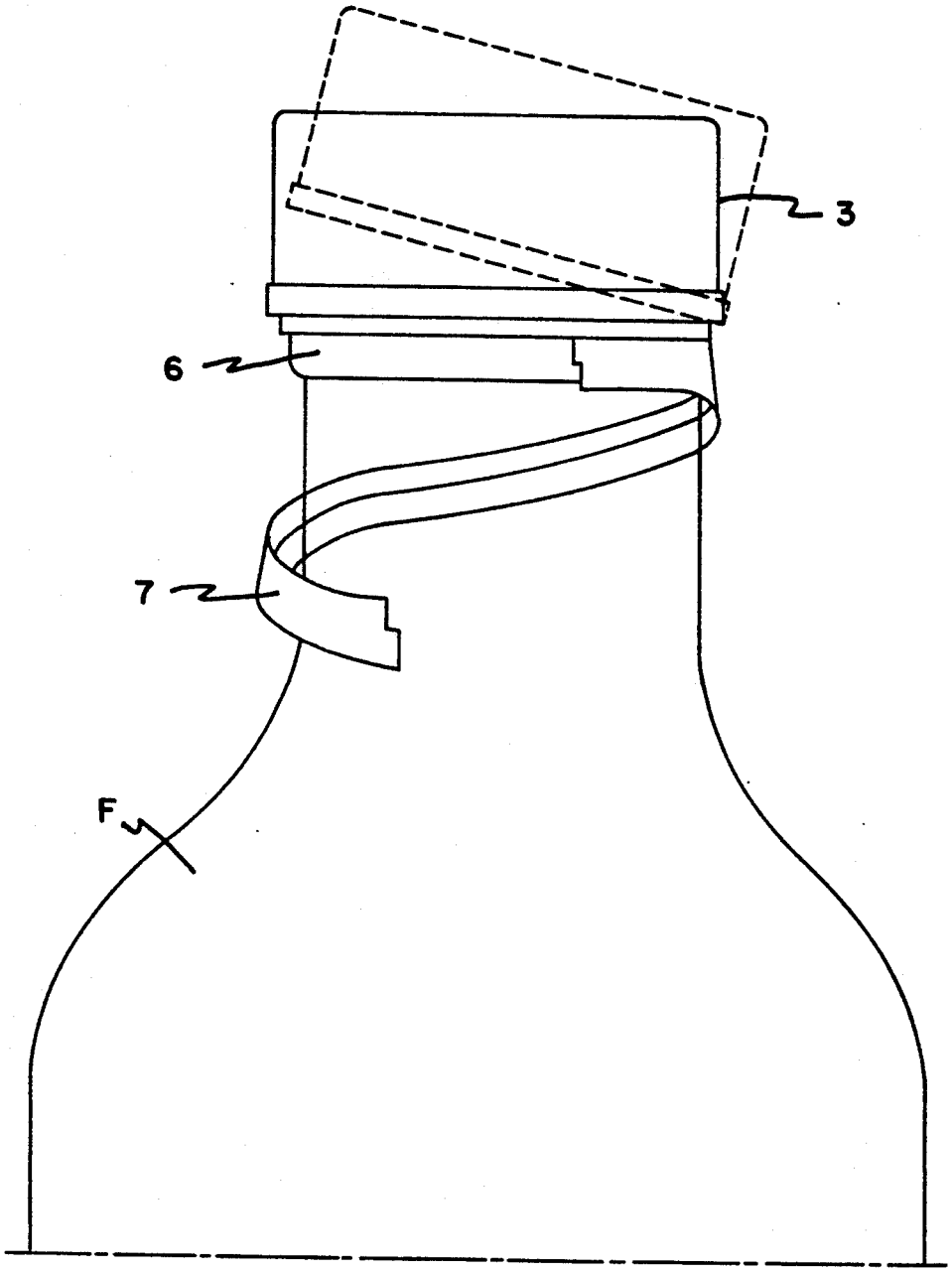

The subject model is characterized in that the wall or natural extension of wall [8]is substantially thinner as compared to skirt [3]and telltale band [7]due to an external diameter reduction [10], this wall also being thinner and provided with a throughgoing and interrupted circular cutting line [11], in which the interruptions [12]are either equidistant or otherwise and substantially smaller as compared to the cutting segments [11'], but with one of them [12']being substantially larger, practically twice or three times as compared to a cutting segment [11'], while also, on said larger interruption [12'], one of the ends of a cutting segment [11']is interconnected with another vertical cut [13]which, in turn, extends to a considerable portion of the telltale band [7], causing it to be more fragile precisely along an imaginary vertical line [14], as likewise occurs with the interruptions [11'], which then begin to function as severable parts when the cap is removed, as illustrated in FIGS. 5, 6 and 7, in which it is seen that, when the cap is unscrewed, the telltale band [7]is forced precisely at its opposite section relative to the larger interruption or nonseverable portion [12']. Therefore, when the cap is unscrewed, interruptions [12]of cutting line [11]unavoidably and progressively begin to split and, when the cap is almost halfway through its outgoing travel, other interruptions or severable parts [11']will begin to split, also at the said vertical cut [13], at which time the cap will become fully detached, as will likewise occur with seal's strip, but with the latter remaining attached to the cap, even after complete removal thereof.

The subject model is also characterized in that the lower edge of the telltale band [7]is designed with a sharp, almost wedge-shaped cross section [15], causing discomfort or a sensation of pain if the cap and seal are forced manually outward during a possible attempt to violate the assembly.

It is likewise noteworthy that the interruptions [11']of the cutting line [11], also defined as severable parts, will change color if possibly submitted to a stretching effort, but without the parts [11']being severed, since such a stretching force will be sufficient to change the molecular orientation and transparency (refraction) of the thermoplastic material employed.

From the above detailed description it will be noted that the object of the present invention is to provide a design for a plastic cap especially developed to fulfill a variety of needs, of which the following stand out:

a) to include an inviolable device with a telltale ring [7]which, by means of a cutting line interrupted at various severable points, is structurally attached to the body of the cap, so that, when the latter is unscrewed, the severable parts [12]split in a crosswise direction, while the band or seal [7](lower ring) also comes apart vertically at the weakened line [13];

b) to be provided with a telltale ring [7]with suitable cross section so that it may be locked under the locking ring or collar [C]on the neck of the glass or plastic flask [F];

c) the splitting of the telltale band avoids the need to rework the sealing ring for removal thereof from returnable bottles and also provides double proof that the container has been tampered with;

d) to provide a screw thread [5]with intervals [16]to enable quick decompression of the product contained (when pressurized) within the bottle. In carbonated beverages, it is common for pressure to build up at the upper part of the container, due to the product's gas content (usually $CO_2$). If the container is inadvertently opened, or reopened, this pressure may cause the cap to be ejected unexpectedly, being able to inflict physical harm on the consumer. The thread or fillet (split or with intervals) allows the container's gas or internal pressure to be dispersed quickly before the cap has been fully removed; and e) to be provided with dimensions for walls and inside thread profiles that cooperate with the threads on the bottleneck of containers for gas-charged beverages, being able to withstand the internal pressures of these liquid, gas-charged or carbonated-ed products.

What is claimed is:

1. A flask cap for capping a flask having first threads and a collar, comprising a flat upper disk with a cylindrical skirt extending downwardly therefrom, said skirt having a body with an external diameter and a band and an interconnecting wall having an axial extent, said interconnecting wall connecting said body and said band, said body having second threads which mate with said first threads, said interconnecting wall having an external diameter which is less than the external diameter of said body, said band including a circular projection within angular profile, said interconnecting wall having a plurality of cut segments having an axial extent, said cut segments being aligned in a circular fashion and separated by a plurality of transverse interruptions, said cut segments being positioned within the axial extent of said interconnecting wall and being axially spaced from said body, said axial extent of said cut segments being substantially less than the axial extent of said interconnecting wall, said band further including a vertical cut with vertical interruptions, wherein said band forms an inviolable device such that said projection extend over the collar of said flask in an irreversible coupling and wherein during attempted removal, said transverse interruptions and said vertical interruptions sever to release said band from said collar.

2. The cap according to claim 1, wherein said cap has a lower edge, said lower edge being sharp, so as to cause discomfort or a sensation of pain if the cap and seal are forced manually outward during a possible attempt to violate the coupling.

3. The cap according to claim 1, wherein said cap is made from a thermoplastic material and wherein said transverse and vertical interruptions of the cutting line, also defined as change color when submitted to a stretching effort, without being severed, since such stretching is sufficient to change molecular orientation and transparency of the thermoplastic material.

* * * * *